US008894183B2

(12) United States Patent
Ohira

(10) Patent No.: US 8,894,183 B2
(45) Date of Patent: Nov. 25, 2014

(54) PROCESS FOR PRODUCING LIQUID EJECTION HEAD AND LIQUID EJECTION HEAD

(71) Applicant: Canon Kabushiki Kaisha, Tokyo (JP)

(72) Inventor: Masatoshi Ohira, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 65 days.

(21) Appl. No.: 13/768,352

(22) Filed: Feb. 15, 2013

(65) Prior Publication Data

US 2013/0229463 A1 Sep. 5, 2013

(30) Foreign Application Priority Data

Mar. 2, 2012 (JP) ..... 2012-046578

(51) Int. Cl.
*B41J 2/16* (2006.01)
*B41J 2/14* (2006.01)

(52) U.S. Cl.
CPC ..... *B41J 2/1623* (2013.01); *B41J 2/14024* (2013.01); *B41J 2/1601* (2013.01); *B41J 2/1433* (2013.01); *B41J 2/1631* (2013.01); *B41J 2/1626* (2013.01)
USPC ..... 347/47; 347/50; 347/65

(58) Field of Classification Search
CPC ..... B41J 2002/14419; B41J 2202/20; B41J 2202/14306; B41J 2002/14362; B41J 2/1623; B41J 2202/19; B41J 2/145
USPC ..... 347/40, 49–50, 56, 58, 59, 65, 66, 71
See application file for complete search history.

(56) References Cited

U.S. PATENT DOCUMENTS

| | | | | |
|---|---|---|---|---|
| 5,657,063 | A | 8/1997 | Takahashi | |
| 6,302,512 | B1 | 10/2001 | Ikegame et al. | |
| 8,011,778 | B2 * | 9/2011 | Harada et al. | 347/100 |
| 2009/0309938 | A1 | 12/2009 | Yoneda | |

FOREIGN PATENT DOCUMENTS

| | | | |
|---|---|---|---|
| CN | 101204878 | A | 6/2008 |
| JP | 2001-270115 | A | 10/2001 |
| JP | 2006-212902 | A | 8/2006 |
| JP | 2011-062866 | A | 3/2011 |

OTHER PUBLICATIONS

Office Action in Chinese Patent Application No. 201310061378.8, dated Aug. 28, 2014.

* cited by examiner

*Primary Examiner* — Thinh Nguyen
(74) *Attorney, Agent, or Firm* — Fitzpatrick, Cella, Harper & Scinto

(57) ABSTRACT

A process, which produces a liquid ejection head including a recording element substrate having a principal surface and a support member having a color separation wall for ink flow paths and an outer wall, the substrate being narrower than the support member, a plane formed by conducting translation of a lower side of a substrate outer surface perpendicularly to the principal surface having an intersection with an outer wall top surface at a position distant from an inner edge of the outer wall top surface by an outward distance, includes applying an adhesive onto top surfaces of the outer and color separation walls such that a surface height of the adhesive at the intersection is higher than that at a position distant from an inner edge of the color separation wall top surface by the outward distance, and bonding and fixing the substrate to the support member with the adhesive.

20 Claims, 5 Drawing Sheets

PROCESS FOR PRODUCING LIQUID EJECTION HEAD AND LIQUID EJECTION HEAD

BACKGROUND OF THE INVENTION

1. Field of the Invention

The present invention relates to a process for producing a liquid ejection head for ejecting a liquid such as an ink to conduct recording operation as well as a liquid ejection head.

2. Description of the Related Art

A liquid ejection head used in liquid ejection apparatus represented by an ink jet recording apparatus has heretofore been provided with a recording element substrate 1, a flow path 5 and a support member 6 as illustrated in FIGS. 5 to 6B. The recording element substrate 1 is provided with an ink ejection orifice, and the support member 6 has the flow path 5 for supplying an ink. Silicon is generally used as the recording element substrate 1, and the support member 6 is made of a resin.

As illustrated in FIG. 5, a method of bonding and fixing the recording element substrate 1 with an adhesive 2 is used as a method for fixing the recording element substrate 1 on to the support member 6. The adhesive is applied by a method such as dispensing or transferring methods.

Here, a color recording element substrate 1 having a plurality of flow paths 5 is considered in particular. The adhesive 2 is pressed against a back surface of the recording element substrate 1 and spread when the recording element substrate 1 is bonded and fixed. It is necessary to control the height of the adhesive 2 so as not to excessively narrow the flow paths 5 due to squeeze-out of the adhesive. If the height of the adhesive at respective parts is uneven, there is a possibility that adhesion failure may occur to leak the adhesive 2 to an exterior or an interior (between color separation walls).

Japanese Patent Application Laid-Open No. 2006-212902 discloses a method for keeping a pattern right after application of an adhesive by providing a V-shaped groove in an adhesive application portion of a support member 6 so as to make it possible to apply a small amount of the adhesive with an even height and to prevent the spread of the adhesive.

Even when the application height of the adhesive is stabilized according to the method disclosed in Japanese Patent Application Laid-Open No. 2006-212902, however, leakage to the exterior may occur in such a situation as illustrated in FIG. 5 in some cases. Since the support member 6 is molded from a plastic, there is a production limit to the narrowing of the width of a color separation wall 4. In addition, it is necessary for the flow path 5 to surely have a certain width from a viewpoint of bubble-releasing ability (width necessary to naturally release a bubble in an ink).

There is a limit to the narrowing of the widths of the color separation wall 4 and flow path 5 for their respective reasons. However, the recording element substrate 1 bonded and fixed on to the support member 6 tends to narrow its width 20 for the purpose of reducing the cost rate of the resulting head. As a result of the development of this narrowing technology, a possibility that such an outer leakage defect 21 that an outer portion of the recording element substrate 1 comes into no contact with the adhesive 2 as illustrated in FIG. 6B may occur has emerged. Here, FIG. 6B is a sectional view taken along line 6B-6B in FIG. 6A.

The outer leakage defect 21 can be suppressed when a squeezed amount of the adhesive 2 is increased. However, the adhesive 21 squeezed out narrows the flow path 5 if the adhesive 21 is over squeezed, so that the squeezed amount of the adhesive cannot be increased more than a certain amount taking into account the bubble-releasing ability. Accordingly, there is a demand for ensuring adhesion at the outer portion by another method for producing a liquid ejection head without causing leakage to the exterior.

SUMMARY OF THE INVENTION

According to the present invention, there is provided a process for producing a liquid ejection head comprising a recording element substrate having a principal surface provided with an ejection orifice for an ink and a support member having a plurality of flow paths for supplying the ink to the recording element substrate, the support member having a color separation wall and an outer wall, the recording element substrate having a width narrower than the support member, a plane formed by subjecting a lower side of an outer lateral surface of the recording element substrate to parallel translation in a direction perpendicular to the principal surface having an intersection line with a top surface of the outer wall at a position distant from an inner edge of the top surface of the outer wall by a predetermined outward distance, the process comprising an adhesive application step of applying an adhesive on to the top surfaces of the outer wall and the color separation wall in such a manner that a surface height of the adhesive at the intersection line is higher than a surface height of the adhesive at a position distant from an inner edge of the top surface of the color separation wall by the predetermined outward distance, and a recording element substrate adhesion step of bonding and fixing the recording element substrate to the support member with the adhesive.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 4:
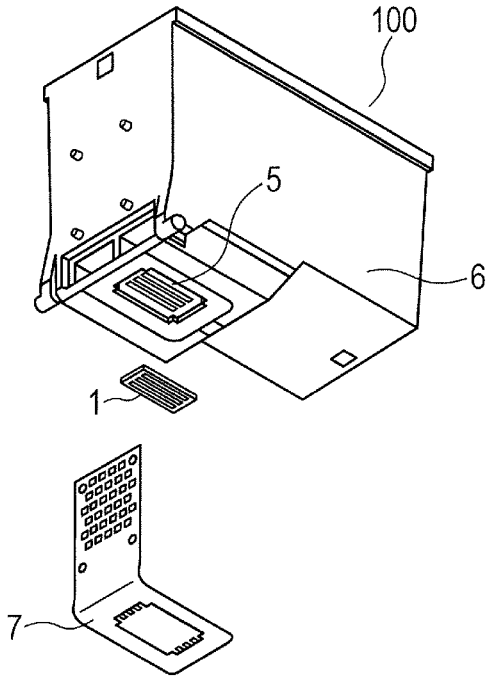
FIG. 4 is an exploded perspective view of a liquid ejection head according to each of the respective embodiments.
Figure 5:
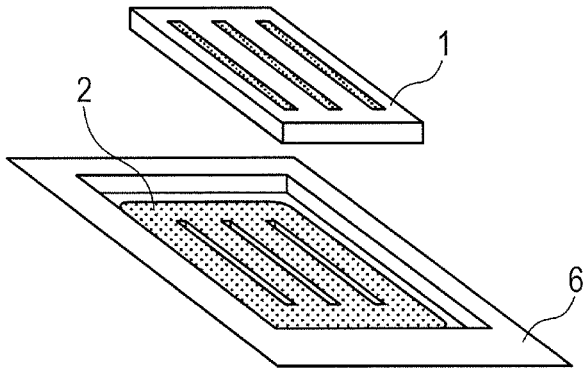
FIG. 5 PRIOR ART
FIG. 5 is a perspective view illustrating a recording element substrate adhesion part of a conventional liquid ejection head.
Figure 6A:
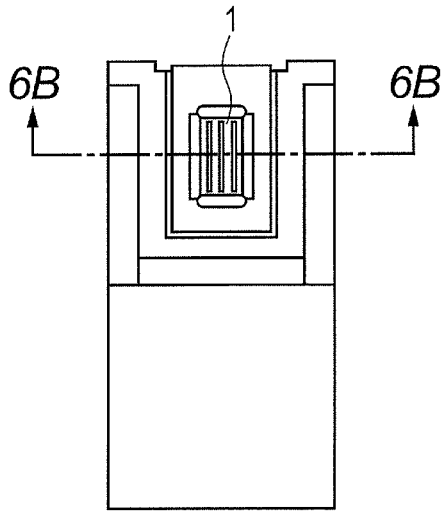
FIG. 6A PRIOR ART
FIG. 6A is a schematic top view illustrating the recording element substrate adhesion part of the conventional liquid ejection head.
Figure 6B:
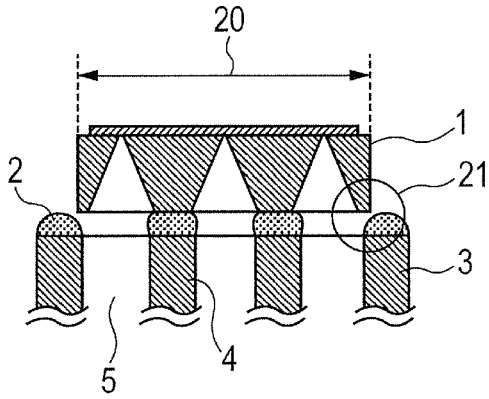
FIG. 6B PRIOR ART
FIG. 6B is a sectional view taken along line 6B-6B in FIG. 6A.

FIG. 4 is an exploded perspective view of a liquid ejection head for ejecting a liquid such as an ink in the present invention, and the liquid ejection head is provided with a recording element substrate 1, an electric wiring substrate 7, an ink flow path 5 and a support member 6. The recording element substrate 1 is provided with an ejection orifice for ejecting the liquid and a supply port (see FIG. 1) for supplying the liquid to an energy generating element for generating energy to be utilized for ejecting the liquid to the ejection orifice, and the electric wiring substrate 7 is connected to the recording element substrate 1 through a lead terminal and gives an electric signal. The support member 6 is provided with a plurality of flow paths 5 in parallel with each other, and each of the flow paths 5 fluidly communicates with the supply port 29 of the recording element substrate 1. A silicon substrate is generally used as the recording element substrate 1, and the support member 6 is made by a resin such as a plastic.

Figure 1:
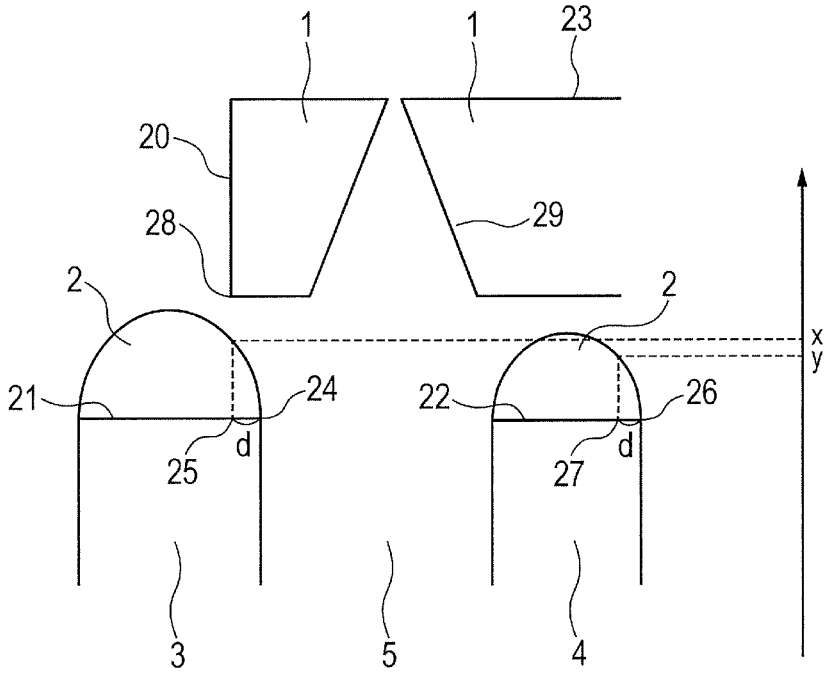
FIG. 1 is a sectional view illustrating a recording element substrate adhesion part according to a first embodiment.
Figure 2A:
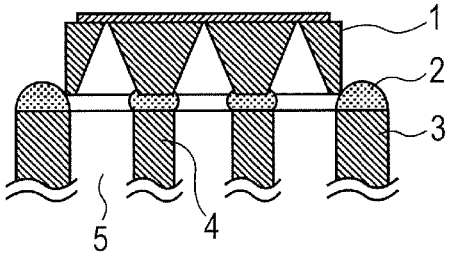
FIGS. 2A, 2B, 2C and 2D are sectional views illustrating recording element substrate adhesion parts according to a second embodiment.

FIG. 1 is a sectional view illustrating a part of a recording element substrate adhesion part in a liquid ejection head 100 according to a first embodiment of the present invention. The flow path 5 is formed by a color separation wall 4, by which adjoining flow paths 5 are partitioned off, and an outer wall 3 formed on the outer side of a flow path located at an end portion. As illustrated in FIG. 1 and FIG. 2A, the width of the recording element substrate 1 is narrower than the support member 6 in a direction of arranging the plurality of the flow paths (horizontal direction in the drawings). Mutual arrangement between the recording element substrate 1 and the support member 6 is such that a plane formed by subjecting a lower side 28 of an outer lateral surface 20 of the recording element substrate 1 in a direction of arranging the supply ports 29 (horizontal direction in the drawings) to parallel translation in a direction perpendicular to the principal surface 23 of the recording element substrate 1 has an intersection line 25 with a top surface 21 of the outer wall 3. Here, the intersection line 25 is located at a position distant from an inner edge of the top surface 21 of the outer wall 3 by a predetermined outward distance d. The lower side 28 of the outer lateral surface 20 of the recording element substrate 1 is parallel with the top surface 21 of the outer wall 3.

An adhesive 2 is applied on to the top surfaces of the outer wall 3 and the color separation wall 4 in such a manner that a surface height x of the adhesive 2 at the position of the intersection line 25 in a direction perpendicular to the top surface 21 is higher than a surface height y of the adhesive on a straight line 27 distant from an inner edge 26 of the top surface 22 of the outer wall 4 by the outward distance d. That is, in this embodiment, the thickness of the adhesive applied to the top surface of the outer wall formed on the outer side of the support member 6 is greater than the thickness of the adhesive applied to the top surface of the color separation wall. The height of the adhesive from the top surface at the position d in the outer wall thereby becomes higher than the height of the adhesive from the top surface at the position d in the color separation wall. The adhesive is applied in this manner, whereby a liquid ejection head 100 which inhibits a liquid flowing in the flow path 5 from leaking to the exterior can be produced even when the recording element substrate 1 having a width smaller than the width of the support member is bonded to the support member.

FIGS. 2A to 2D are sectional views illustrating recording element substrate adhesion parts in a liquid ejection head 100 according to a second embodiment of the present invention. A flow path 5 is formed by a color separation wall 4 and an outer wall 3. In this embodiment, the widths of the color separation wall 4 and the outer wall 3 are set to 0.55 mm and 0.70 mm, respectively. Since a region communicating with a supply port 29 formed in a recording element substrate 1 becomes narrow when the width of the color separation wall is made wide, there is a limit to the width of the color separation wall for ensuring a supply amount. Since the outer wall does not have such a limit, however, the width of the outer wall can be made wide. The width of the outer wall 3 is made wider than the color separation wall 4 in this manner, whereby an adhesive can be applied on to the outer wall 3 higher than the color separation wall 4. When the width of the outer wall 3 is made wider as needed, the adhesive can be applied still higher. As a material forming a support member 6, a wide variety of materials such as resin materials and ceramic materials represented by $Al_2O_3$ (alumina) may be used. In this embodiment, modified PPE (poly(phenylene ether)) was used.

The recording element substrate 1 is such that a plurality of thermal energy generating elements for generating energy to be utilized for ejecting a liquid and wirings for supplying electric power to the thermal energy generating elements are formed on one surface of a silicon substrate by a film forming technology. An ink supply path and an ejection orifice are formed on each of the thermal energy generating elements by a photolithography technology. An opening of a supply port, which is a through-hole for supplying an ink to each ejection orifice, is formed in the other surface of the substrate. This supply port is formed by anisotropic etching.

A method for bonding the recording element substrate 1 to the support member 6 in this liquid ejection head 100 will hereinafter be described. First, the support member 6 is positioned to apply the adhesive 2 on to top surfaces of the outer wall 3 and the color separation wall 4 by a dispensing method. The adhesive 2 is a photo-setting-thermosetting combined type epoxy resin, and a resin having a viscosity of 10 to 14 Pa·sec (20 rpm, E-type rotational viscometer, 25° C.) was used in this embodiment. Here, the moving speed of a coating needle for the adhesive (hereinafter referred to as a coating speed) is made slower on the outer wall than that on the color separation wall. The amount of the adhesive applied to the outer wall is increased with respect to the color separation wall in this manner, whereby the adhesive can be applied higher on the outer wall 3 than the color separation wall 4 corresponding to the breadth of a wall width.

In order to apply the adhesive higher on to the outer wall, the diameter of a coating needle used for the application to the outer wall 3 may be made wider than that of a coating needle used for the application to the color separation wall 4. According to this method, a greater amount of the adhesive can be applied to only the outer wall without changing the coating speed. Further, the height of the adhesive on the outer wall can be made higher than that on the color separation wall even by setting higher a pressure upon application of the adhesive from the needle to the outer wall than that upon application to the color separation wall. Still further, the respective methods may also be suitably combined.

Figure 2B:
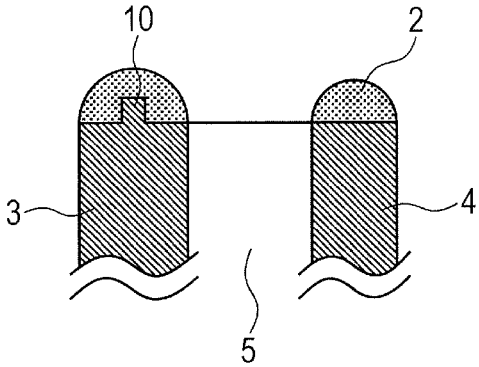
Figure 2C:
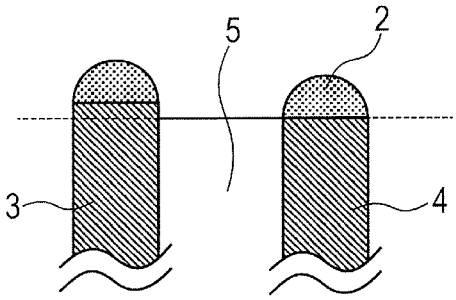

Incidentally, when a projected portion is formed on the top surface of the outer wall as illustrated in, for example, FIG. 2B to make a central portion and a peripheral edge portion of the top surface planes different in height so as to make the height of the central portion higher than the peripheral edge portion, the adhesive can be applied to the desired height even when the amount of the adhesive is smaller by the volume of the central projected portion. In addition, the coating speed can also be increased. It is also favorable to form such a projected portion at an offset position on the side of the adjoining color separation wall 4, not at the central portion illustrated in FIG. 2B, in that the height of the adhesive at the position of the distance d illustrated in FIG. 1 can be made higher. Alternatively, the height of the adhesive may also be ensured without slowing down the coating speed by forming an outer wall 3 having a top surface higher than the color separation wall 4 as illustrated in FIG. 2C.

As described above, the adhesive is applied in such a manner that the surface height of the adhesive on the outer wall becomes higher than that of the adhesive on the color separation wall, and the recording element substrate 1 and the support member 6 are approached to each other to bring the recording element substrate 1 into contact with the adhesive 2, thereby bonding and fixing the recording element substrate 1 at the predetermined position. A liquid supply path with ensured sealing with respect to the outside with which the flow path 5 in the support member 6 and the supply port 29 in the recording element substrate 1 communicate can be thereby formed. In order to more surely achieve the sealability at this time, it is favorable to first bring the adhesive 2 on the outer wall into contact with the recording element substrate 1 when the recording element substrate 1 is approached to the support member 6 and then bring the adhesive 2 on the color separation wall 4 into contact with the recording element substrate 1.

The recording element substrate 1 whose width is narrower than the width of the support member 6 is bonded and fixed to the support member 6 according to the above-described method, whereby a liquid ejection head 100 which inhibits a liquid from leaking can be produced.

Figure 2D:
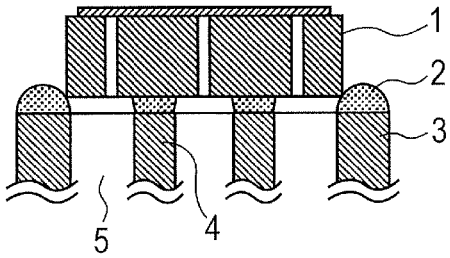

Incidentally, in this embodiment, the supply port in the recording element substrate 1 is formed by the anisotropic etching. However, the supply port is formed in a nearly straight form by, for example, laser beam machining as illustrated in FIG. 2D, whereby the substrate may be smaller sized. It is favorable to apply the present invention to such a recording element substrate.

Figure 3A:
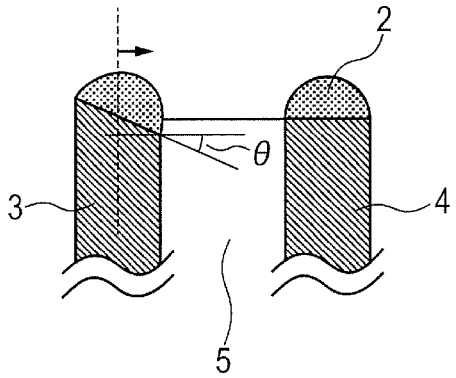
FIGS. 3A, 3B and 3C are sectional views illustrating recording element substrate adhesion parts according to a third embodiment.
Figure 3B:
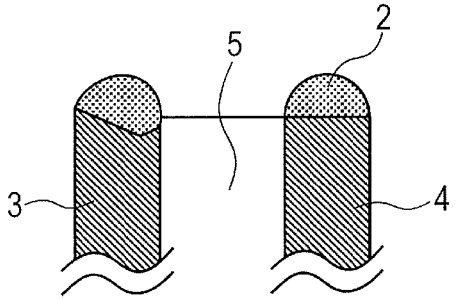
Figure 3C:
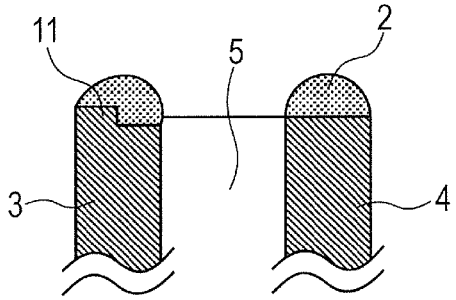

FIGS. 3A to 3C are sectional views illustrating recording element substrate adhesion parts in a liquid ejection head 100 according to a third embodiment of the present invention. As illustrated in FIG. 3A, a top surface of an outer wall 3 is inclined inside (on the side of a color separation wall), and an adhesive 2 which is a photo-setting-thermosetting combined type epoxy resin and has a viscosity of 10 to 14 Pa·sec (20 rpm, E-type rotational viscometer, 25° C.) is applied to this inclined top surface. The top surface of the outer wall 3 is inclined, whereby the point where the surface height of the adhesive 2 applied becomes the highest is kept in a state of being shifted on the inside from a center in a width direction of the outer wall 3. Accordingly, the height of the adhesive at a necessary part can be made higher without increasing the amount of the adhesive applied to the outer wall 3 compared with the amount of the adhesive applied to the color separation wall 4. The small-sized recording element substrate 1 can be thereby bonded and fixed to a support member 6 without causing leakage to the exterior. Incidentally, the angle θ of the inclination may be arbitrarily selected. In this embodiment, the angle was set to 20°. The adhesive applied to such an inclined surface is favorably an adhesive having a relatively high viscosity.

As illustrated in FIG. 3B, an inclined surface may also be provided so as to form a V-shaped form on the inside of the outer wall 3. When such a V-shaped groove (depression) is formed, the deepest portion (top portion) of the groove is formed on the inside from a center in the width direction of the outer wall 3 as illustrated in FIG. 3B, whereby the height of the adhesive at a necessary part can be ensured even with a relatively small amount of the adhesive. In addition, in this embodiment, the retention of the adhesive at the top surface portion is high, so that the overflow of the adhesive can be inhibited. Accordingly, the present invention can be applied to an adhesive having a relatively low viscosity.

As illustrated in FIG. 3C, an inside portion and an outside portion of the top surface 21 of the outer wall 3 may also be allowed to be planes with different heights to provide a level difference so as to make the height of the inside portion lower than the outside portion. Even in this method, a point where the surface height of the adhesive 2 applied becomes the highest is kept in a state of being shifted on the inside from the center of the outer wall 3 like the case of FIG. 3A, so that the height of the adhesive at a necessary part can be ensured.

By such constructions of FIGS. 3A to 3C, the position where the surface height of the adhesive applied to the outer wall becomes the highest can be controlled to the inside with respect to the center in the width direction (the side of the color separation wall). Such a construction is favorable because the amount of the adhesive can be made relatively small.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-046578, filed Mar. 2, 2012, which is hereby incorporated by reference herein in its entirety.

What is claimed is:

1. A process for producing a liquid ejection head comprising a recording element substrate having a principal surface provided with an ejection orifice for an ink and a support member having a plurality of flow paths for supplying the ink to the recording element substrate, the support member having a color separation wall and an outer wall, the recording element substrate having a width narrower than a width of the support member, a plane formed by subjecting a lower side of an outer lateral surface of the recording element substrate to parallel translation in a direction perpendicular to the principal surface having an intersection line with a top surface of the outer wall at a position distant from an inner edge of the top surface of the outer wall by a predetermined outward distance, the process comprising;

an adhesive application step of applying an adhesive onto the top surfaces of the outer wall and the color separation wall in such a manner that a surface height of the adhesive at the intersection line is higher than a surface height of the adhesive at a position distant from an inner edge of the top surface of the color separation wall by the predetermined outward distance; and a recording element substrate adhesion step of bonding and fixing the recording element substrate to the support member with the adhesive.

2. The process according to claim 1, wherein in the adhesive application step a coating speed of the adhesive is made slower on the top surface of the outer wall than that on the top surface of the color separation wall.

3. The process according to claim 1, wherein in the adhesive application step, a diameter of a coating needle used for applying the adhesive to the top surface of the outer wall is made wider than that of a coating needle used for applying the adhesive to the top surface of the color separation wall.

4. The process according to claim 1, wherein an inclination toward the inside is provided on the top surface of the outer wall.

5. A liquid ejection head comprising a recording element substrate having a principal surface provided with an ejection orifice for an ink; and a support member having a plurality of flow paths for supplying the ink to the recording element substrate, wherein the support member has a color separation wall and an outer wall, the recording element substrate has a width narrower than a width of the support member, a plane formed by subjecting, at a position distant from an inner edge of a top surface of the outer wall by a predetermined outward distance, a lower side of an outer lateral surface of the recording element substrate to parallel translation in a direction perpendicular to the principal surface has an intersection line with the top surface of the outer wall, an adhesive is applied on to the top surfaces of the outer wall and the color separation wall in such a manner that a surface height of the adhesive at the intersection line is higher than a surface height of the adhesive at a position distant from an inner edge of the top surface of the color separation wall by the predetermined outward distance, and the recording element substrate is bonded and fixed to the support member with the adhesive.

6. The liquid ejection head according to claim 5, wherein the width of the outer wall is wider than the width of the color separation wall.

7. The liquid ejection head according to claim 5, wherein the top surface of the outer wall is higher than that of the color separation wall.

8. The liquid ejection head according to claim 5, wherein a central portion and a peripheral edge portion of the top surface of the outer wall are planes with different heights, and the central portion is higher than the peripheral portion.

9. The liquid ejection head according to claim 5, wherein the top surface of the outer wall has an inclination directed toward the inside.

10. The liquid ejection head according to claim 9, wherein the top surface of the outer wall has a reverse inclination having a length smaller than that of the inclination in the inside thereof.

11. The liquid ejection head according to claim 5, wherein an inside portion and an outside portion of the top surface of the outer wall are planes with different heights, and the height of the inside portion is lower than that of the outside portion.

12. A process for producing a liquid ejection head comprising a substrate having an element for generating energy to be utilized for ejecting a liquid and a first supply port and a second supply port extending side by side for supplying the liquid to the element, and a support member that has a first opening portion communicating with the first supply port and a second opening portion communicating with the second supply port and supports the substrate, the process comprising:

a first step of applying an adhesive to a first region between the first opening portion and the second opening portion in the support member and a second region on the outer side of the support member from the first opening portion; and a second step of joining the substrate to the support member with an adhesive in such a manner that the first and second supply ports are communicated with the first and second opening portions, respectively, wherein in the first step the height of the adhesive applied to the second region is higher than the height of the adhesive applied to the first region.

13. The process according to claim 12, wherein the support member has a third opening portion communicating with a third supply port formed in the substrate, and the second opening portion is arranged between the first opening portion and the third opening portion.

14. The process according to claim 13, wherein the first opening portion, the second opening portion and the third opening portion are arranged in that order from one end portion of the support member.

15. The process according to claim 12, wherein the length of the second region in a direction in which the first opening portion and the second opening portion are arranged is longer than the length of the first region.

16. The process according to claim 12, wherein in the second step an end surface of the substrate on the side where the first supply port is formed is located on the side of the second opening portion from a center in the direction in which the first opening portion and the second opening portion are arranged.

17. A liquid ejection head comprising:

a substrate having an element generating energy utilized for ejecting a liquid and first, second and third supply ports extending side by side for supplying the liquid to the element; and a support member having a first opening portion communicating with the first supply port, a second opening portion communicating with the second supply port and a third opening portion communicating with the third supply port and joined to the substrate with an adhesive, wherein the first opening portion, the second opening portion and the third opening portion are arranged in that order in a direction toward the other end portion from one end portion of the support member, and a region on the side of the end portion from the first opening portion in the support member, to which the adhesive is applied, has a first inclined surface lowering toward the side of the second opening portion.

18. The liquid ejection head according to claim 17, wherein the region of the support member has a second inclined surface rising toward the side of the second opening portion, and an insertion part between the first inclined surface and the second incline surface is located on the side of the second opening portion from a center in the direction of the region.

19. A liquid ejection head comprising:

a substrate having an element for generating energy to be utilized for ejecting a liquid and a first supply port, a second supply port and a third supply port extending side by side for supplying the liquid to the element; and a support member that has a first opening portion communicating with the first supply port, a second opening portion communicating with the second supply port and a third opening portion communicating with the third supply port and is joined to the substrate with an adhesive, wherein the first opening portion, the second opening portion and the third opening portion are arranged in that order in a direction from one end portion of the support member toward the other end portion, and a region on the side of the end portion in the support member where the adhesive is applied from the first opening portion has a level difference portion with the side of the second opening portion being lower.

20. A liquid ejection head comprising:

a substrate having an element for generating energy to be utilized for ejecting a liquid and a first supply port, a second supply port and a third supply port extending side by side for supplying the liquid to the element; and a support member that has a first opening portion communicating with the first supply port, a second opening portion communicating with the second supply port and a third opening portion communicating with the third supply port and is joined to the substrate with an adhesive, wherein the first opening portion, the second opening portion and the third opening portion are arranged in that order in a direction from one end portion of the support member toward the other end portion, and a projected portion is formed in a region on the side of the end portion in the support member where the adhesive is applied from the first opening portion.

* * * * *